United States Patent [19]

Benoit

[11] 4,283,245

[45] Aug. 11, 1981

[54] BOTTLE LABELLING APPARATUS

[76] Inventor: Horst A. Benoit, 510 Richey Crescent, Mississauga, Ontario, Canada, L5G 1N4

[21] Appl. No.: 30,770

[22] Filed: Apr. 17, 1979

Related U.S. Application Data

[63] Continuation-in-part of Ser. No. 844,595, Oct. 25, 1977, abandoned.

[30] Foreign Application Priority Data

Oct. 18, 1977 [CA] Canada ..... 288967
Sep. 29, 1978 [GB] United Kingdom ..... 38678/78

[51] Int. Cl.[3] ..... B65C 9/02; B65C 9/06

[52] U.S. Cl. ..... 156/476; 156/556; 156/557; 156/566; 156/DIG. 25; 156/DIG. 27; 198/345; 198/436; 198/653

[58] Field of Search ..... 156/539, 542, 556, 557, 156/566, DIG. 25, DIG. 27, 475, 476, 488, 489, 491; 198/345, 436, 653, 654

[56] References Cited

U.S. PATENT DOCUMENTS

| | | | |
|---|---|---|---|
| 1,102,832 | 7/1914 | Wetmore | 156/557 |
| 2,681,743 | 6/1954 | Phin et al. | 156/571 |
| 2,725,156 | 11/1955 | Manas | 156/566 |
| 3,306,803 | 2/1967 | Holstein | 156/539 |
| 3,536,570 | 10/1970 | Holstein | 156/566 |
| 3,726,746 | 4/1973 | Hansen | 156/566 |
| 3,960,640 | 6/1976 | Mort, Jr. et al. | 156/566 |
| 4,060,446 | 11/1977 | Carter | 156/475 |

FOREIGN PATENT DOCUMENTS

| | | | |
|---|---|---|---|
| 421228 | 12/1934 | United Kingdom | 156/DIG. 25 |

*Primary Examiner*—Michael G. Wityshyn

[57] ABSTRACT

Container conveying apparatus comprises a conveyor for conveying evenly spaced-apart containers and means for individually engaging containers and shifting containers laterally of the conveyor. Such container conveying apparatus may be used in association with container labelling apparatus where lateral movement of container on conveyor is desired preparatory to the next labelling step.

41 Claims, 11 Drawing Figures

BOTTLE LABELLING APPARATUS

This application is a continuation-in-part of Ser. No. 844,595, filed Oct. 25, 1977, now abandoned.

FIELD OF THE INVENTION

This invention relates to conveying apparatus, such as that which may be used with labelling devices where the conveying apparatus includes a device for individually engaging containers and shifting them laterally of the conveyor as they are moving.

BACKGROUND OF THE INVENTION

Systems which involve multiple step label applications in applying several different types of labels to various surfaces on a container necessitate control of the container position so that each particular label is consistently applied to each container. In the distillery, some food processing and pharmaceutical industries, it is often required to place a security seal or tax excise stamp on the top of the container or bottle in conjunction with other labels on the body and neck of each container.

With these types of labelling operations, there is often a need to shift the bottle on the conveyor while maintaining control on its position to accomplish a step in the labelling operation, such as applying a tax excise stamp on the top of the container. In other uses for container conveying systems, it may be necessary to shift a bottle or container laterally of the conveyor to accomplish other operations, such as taking a single row of conveyed containers and shifting every other one in a direction opposite to that of the other containers or simply shifting every other container out of the row laterally to now provide two parallel rows of containers. In instances where it is important to maintain container registration, control on its position, or even spacing between containers, then the shifting must be accomplished in an accurate, controlled manner.

Accomplishing a shift of containers on the conveyor, while maintaining control on container position, has been difficult to achieve. For example, well-known approaches such as using deflector plates to move containers in one direction or another as they are conveyed, is satisfactory insofar as establishing new lines of conveyed containers; however, it is necessary to incorporate into the newly formed line a bottle registration or bottle spotter mechanism to re-register the conveyed containers.

In instances where bottle position orientation is not important, yet it is still desired to divide a single row of conveyed containers into two or more rows or to regroup plural rows of conveyed containers, it is possible to obtain a machine which is timed to push conveyed bottles laterally on the conveyor. The difficulty with such pushing mechanisms is that at higher speeds they tend to upset conveyed bottles as they contact them to move them laterally of the conveyor.

SUMMARY OF THE INVENTION

The container conveying apparatus, according to this invention, comprises means for conveying containers and container registration means for evenly spacing such containers on the conveyor. Container shift means is provided for individually engaging such conveyed containers and shifting such engaged containers laterally of the conveyor means a predetermined extent.

Thus, the container shift means provides a row of shifted evenly spaced-apart containers. In other words, the position of the container relative to the direction of travel of the conveyor is maintained.

Such container conveying apparatus may be used in labelling apparatus, such as that for applying a label strip to a container top. The container shift means may be used to align bottle neck portions which are offset relative to the bottle centre line so that the bottle top is aligned with means for applying a strip thereto. The container conveying apparatus may also be used in instances where it is desired to divide a single row of evenly spaced containers into two rows of evenly spaced-apart containers now having a spacing double that of the single row. In instances where the container tops are to be labelled, a pair of strip labellers may be used to label the container tops now proceeding in two rows.

According to a feature of the apparatus, a means for engaging such containers may comprise a plurality of opposing compression pads which travel alongside and with the conveyor and which are adapted to receive and engage individual containers. Each pair of opposing compression pads, with container therebetween, may be shifted laterally to achieve the desired new positioning of that container on the conveyor.

A further feature of the container conveying apparatus, according to this invention, is that it may be adapted to provide means for controlling movement of opposing compression pads such that one of the pads is removed from the container while the other pad, still in contact with the conveyed container, serves to shift it laterally on the conveyor. In this instance, container orientation and/or registration is not of importance and is applicable in areas where it is desired to split a row of containers into two or more rows or regroup plural rows for purposes of container inspection, packaging of containers, etc.

DESCRIPTION OF THE DRAWINGS

The preferred embodiments of the invention are shown in the drawings wherein.

DETAILED DESCRIPTION OF THE PREFERRED EMBODIMENTS OF THE INVENTION

Figure 1:
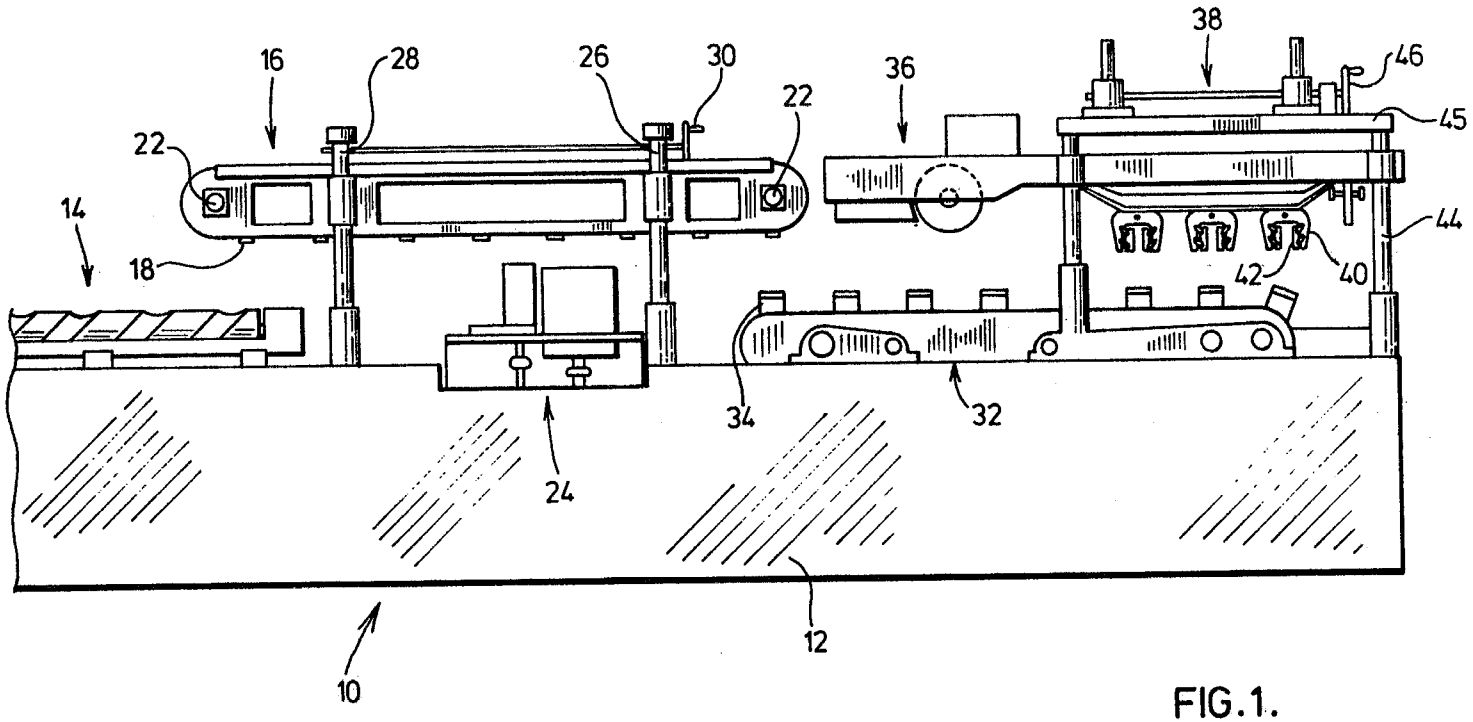
FIG. 1 is a side elevation of the labelling apparatus according to a preferred embodiment of this invention.

The labelling apparatus 10, as shown in FIG. 1, comprises a base 12 which houses the drive mechanism for the labelling apparatus. A conveyor (not shown) runs the length of the apparatus 10 where, at the upstream end of the conveyor, is a portion of a conventional bottle registration device 14 which evenly spaces apart the bottles on the conveyor. Incorporated with the bottle registration means may be a conventional bottle orientation or bottle spotter device (not shown) which orients the bottles all in the same direction on the conveyor. An overhead engaging means 16 is provided above the conveyor and comprises a plurality of resilient blocks 18 mounted on an endless chain system which is trained over sprockets bearingly mounted on shafts 22. Support members 26 and 28 support the overhead assembly above the conveyor. A crank 30 is provided for raising and lowering the overhead assembly 16 up and down on the supports 26 and 28. This provides the adjustment necessary in handling bottles of different heights, so that the distance between resilient blocks 18 and the conveyor is approximately the same as the height of the bottle to be labelled. It is understood that the distance between the blocks 18 and the conveyor determines the frictional force exerted on the bottle as it is sandwiched between the blocks 18 and the conveyor. By fine adjustment of crank 30, this force can be readily altered. A further aspect of the overhead assembly will be discussed in more detail respecting the embodiment shown in FIG. 6.

As the bottles exit from the bottle registration and spotter means, they are conveyed to the overhead engagement means 16, its movement is synchronized so that the blocks 18 contact the bottle tops to hold each bottle on the conveyor in its registered oriented position. The bottles are conveyed in this manner past a label applying station 24 which applies labels to a bottle body, that is the sides and neck of the bottle. It is understood, of course, that several of these label applying devices may be located on each side of and spaced-apart along the conveyor to apply labels on the container's sides and neck portions.

The label compression station conforms labels to the sides and neck of the container subsequent to their application at label applying station 24. There are various forms of compression stations known in the art. The one shown in the drawings is representative of one form. Among other known types is a unit which has a plurality of opposing compression pads mounted on endless chain systems. Each chain system causes the corresponding pads to revolve in a horizontal plane where a portion of their movement is alongside the conveyor. The unit is synchronized and properly positioned to sandwich a respective container between opposing pads as they swing towards each other at the upstream end of the unit.

Label compression station 32 is a preferred arrangement. It has a plurality of opposing compression pads 34 which are mounted in an evenly spaced-apart manner on endless chain systems located on each side of the conveyor as more clearly shown in FIG. 2. The movement of the label compression station is such that each bottle has freshly applied labels compressed against its body by opposing compression pads 34, as the pads move along through a vertical plane on the endless chain system with the corresponding conveyed bottle. As is shown in FIG. 1, the compression pads 34 contact the bottle prior to the resilient block 18 of the overhead engagement means disengaging the bottled top.

While the labels are being compressed against the bottles, they are conveyed to and underneath the security seal applying device generally designated 36 which applies a seal to the bottle top. The security seal may take on various shapes and sizes, as will be understood by those skilled in the art. For example, in the North American distillery business, the security seal (tax excise stamp) is usually a long narrow strip which is applied to the bottle top and is folded down onto and applied to the bottle neck. The compression pads 34 maintain control on the orientation and registration of the bottle as it is conveyed to the label strip applicator to ensure accurate location of the strip on the bottle top. The compression station 32, therefore, serves a dual function. In this particular embodiment, the compression pads 34 continue to hold the bottles as they are conveyed to the strip stamp compression station generally designated at 38 which conforms the strip stamp to the bottled top and neck side. Each compression unit 40 includes pad members 42 which conform to the neck configuration to ensure a neat application of the strip stamp to the bottled top and neck. The support members 44 and overhead assembly 45 for the strip stamp compression station 38, includes a crank 46 which allows the operator to adjust the height of the compression station to accommodate various bottle heights.

Figure 2:
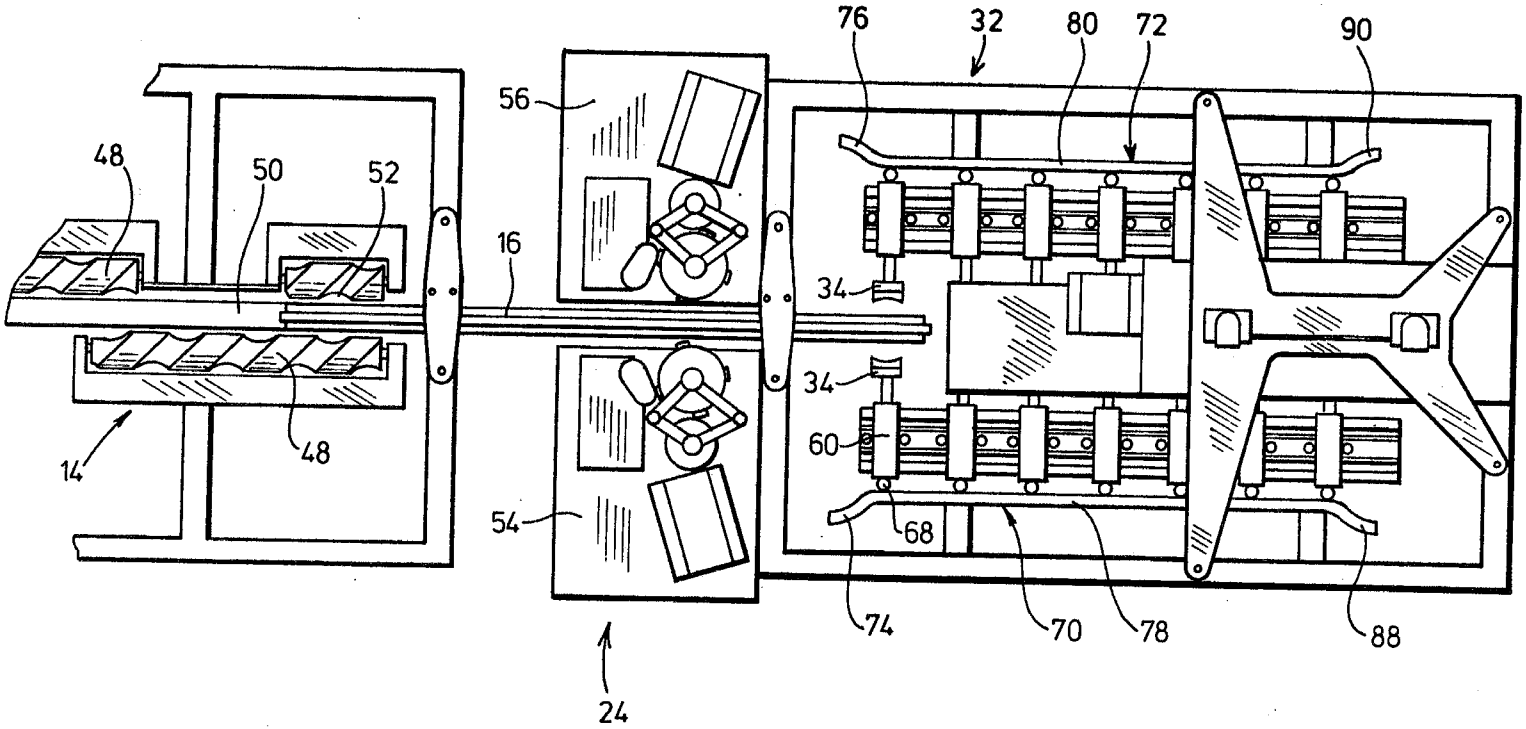
FIG. 2 is a top plan view of the labelling apparatus shown in FIG. 1.

Turning to FIG. 2, the known bottle registration device 18 has rotating opposing screw members 48 which interact with the bottle sides to evenly space them apart on the conveyor belt 50. The overhead compression station 16 contacts the bottle top when the bottle is being moved forward by the registration device 18. In the same area as the bottle registration device, there may be a bottle orientation means for spotting every bottle in the same direction on the conveyor 50. Such bottle spotters are known and may be of the type disclosed in Canadian Pat. No. 693,147.

The label applying station 24, as shown in FIG. 2, for applying labels to the front and back of the bottle. Such devices may be of the type disclosed in Canadian Pat. No. 745,003. The bottle with the labels contacting its back and front surfaces is conveyed to the compression station 32 where the compression pads 34 travel along and initially inwardly towards the conveyor 50 to contact the bottles before their discharge from the overhead engaging means 16. Control on the registration and orientation of each bottle is thereby maintained.

Figure 3:
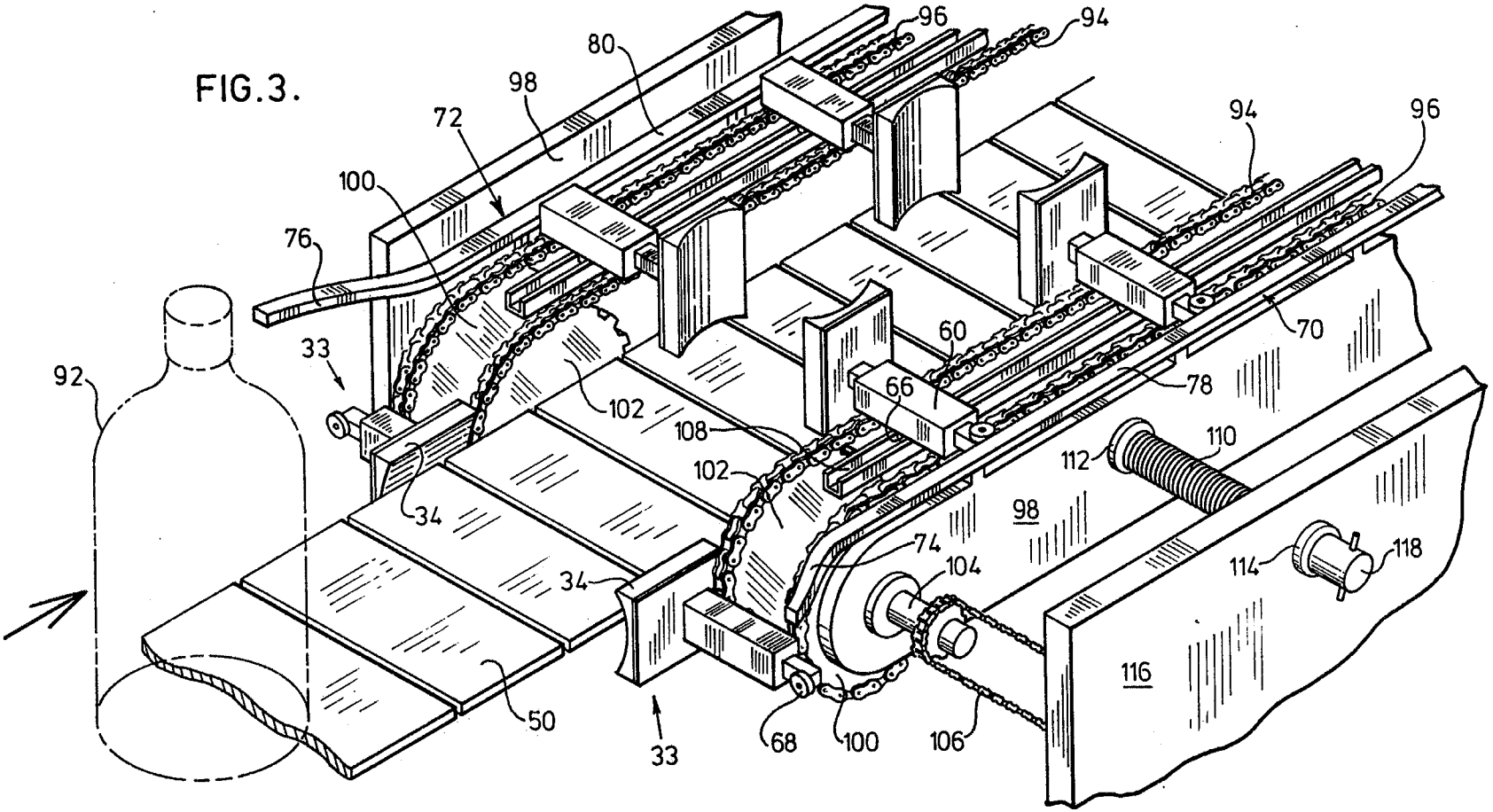
FIG. 3 is an isometric view of a portion of the label compression station of the apparatus.
Figure 4:
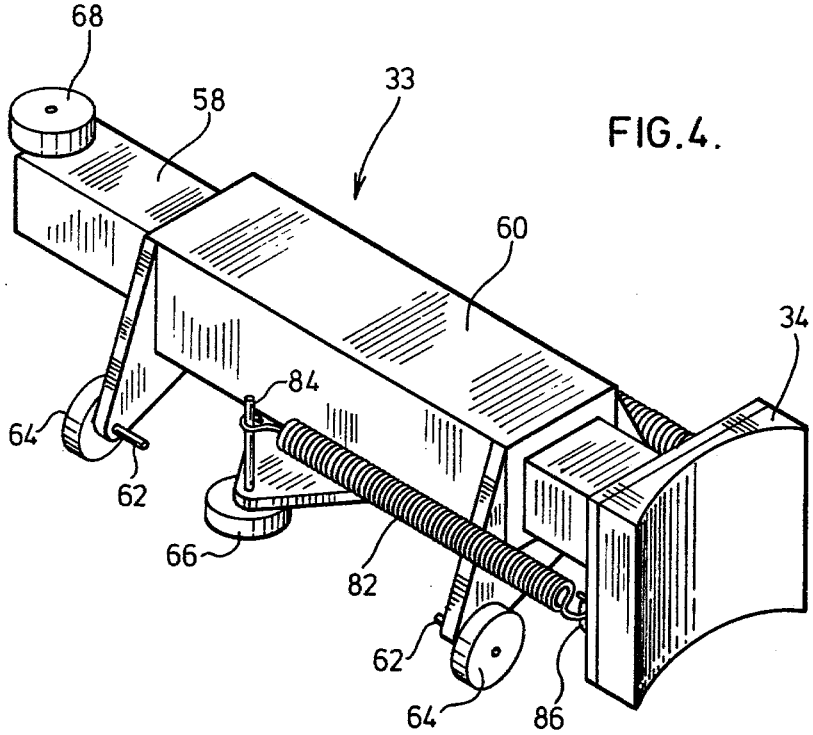
FIG. 4 is a detail showing the preferred construction of a compression pad of the label compression station.

The label compression pad assembly 33 is shown in more detail in FIG. 4, where each interchangeable compression pad 34 is mounted by a "quick release" mechanism (not shown) on a rod 58 which, in turn, is bearingly mounted in a sleeve 60. The sleeve 60 is securely mounted on an endless chain system of two parts by pins 62. Followers 64 and 66 ride in channels to maintain proper location of the sleeve 60 alongside the conveyor as the chain system rotates which will be discussed in more detail with respect to FIG. 3. The rear portion of the rod 58 includes a cam follower 68.

Located on each side of the conveyor are opposing cam rails 70, 72 shown in FIG. 2. As the sleeves 60 move around the trained system through a vertical plane, the cam follower 68 of each compression pad contacts the lead in portions 74 and 76 of cams 70 and 72 to move opposing compression pads 34 laterally inwardly towards the conveyor. Adjustment means, which will be discussed in more detail with respect to FIG. 3, are provided on each side of the conveyor to adjust the spacing between cam rails 70 and 72. They ensure that the compression pads 34 move inwardly the proper extent to engage each bottle and begin compressing the labels against each bottle. Also to ensure that they have a sufficient hold on each bottle prior to the overhead means disengaging the respective bottle. The compression pads 34, as they contact the container with the pads at their innermost position as determined by the intermediate portions 78 and 80 of the cam rails, achieve the highest degree of label compression on the bottles. This is continued for the length of cam portions 78 and 80 which is usually long enough to allow the glue on the labels to set.

Tension springs 82 are provided on each compression pad assembly, as shown in FIG. 4, where one end of the spring is connected to pin 84 and the other end is connected to a side of the compression pad at 86. The tension springs 82 serve to bias or resiliently urge the compression pad assembly in a manner such that, with the pad in its "bottomed out" position, the cam follower 68 engages the lead in portions 74, 76 and maintains the follower against the intermediate portions and the fall-away portions 88 and 90 of the cam rails to accurately determine the opposing position of matched compression pads 34 as they follow along with the conveyed container sandwiched between them.

The shape of compression pads 34 is such to conform to particular shape of bottle sides and necks to be labelled where the pads may be formed from resilient foam. The particular shape of the pad shown in FIG. 4 is, for engaging a side of a circular bottle. The pad may include "add on" portions which are also activated by the cam rails to engage the sloping and neck portions of a bottle simultaneously with the pad contacting the bottle sides.

As shown in FIG. 3, a bottle 92 is conveyed on the conveyor 50. The compression pad assemblies 33 are mounted on endless chain systems 94 and 96 on each side of the conveyor 50. Cam rails 70 and 72 are mounted on support members 98 in which shaft 104 for sprockets 100 and 102 on each side of the conveyor is journalled. The chains 94, 96 are trained over the sprockets 100 and 102 and are driven by drive chain 106. The speed of chain 106 is synchronized with the conveyor speed, so that each bottle 92, as it is conveyed through the compression station 32, is contacted accurately with opposing compression pads 34.

The compression pad assemblies 33 travel through a loop in a vertical plane determined by endless chain systems 94, 96. They are swung upwardly at the upstream end of the compression station 32 where cam followers 68 contact lead in portions 74, 76 of the cam rails to move opposing compression pads 34 inwardly. As mentioned, the spacing between intermediate portions 78 and 80 determine the correct spacing between the pads to properly contact containers 92. As is shown in FIG. 3, roller 66 travels in rail 106 located on each side of the conveyor to maintain constant positioning of the sleeve 60 relative to the conveyor 50. The additional rollers 64 on the sleeve 60 contact other channels (not shown) to ensure that the sleeve does not appreciably wobble during the label compression phase.

Connected to each chain system is an adjustment means comprising a screw shaft 110 which is threaded through a collar 112 in support members 98. The screw shaft 110 is also journalled in collar 114 mounted in stationary support plate 116. A crank may be provided to engage the shaft end 118 to turn it in either direction. The drive shaft 104 and other support shafts for the endless chain system and its sprockets, are spline shafts which allow the sprockets 100 and 102 and others to shift back and forth on the spline shafts without disrupting the timing of the mechanism. As can be appreciated with the support member 116 stationary, rotation of the screw shaft 110 will move the chain assembly with cam rail 70 secured thereto in either direction towards or away from conveyor 50. A similar adjustment means is provided for the chain system on the other side of the conveyor to adjust the position of cam rail 72.

With this arrangement, the position between the cam rails and the compression pad assembly 33 always remains constant to eliminate the need to change the length of shaft 58 of each compression pad assembly 33 for extreme positioning of the cam rails. The adjustment screw 110 can, therefore, be used to precisely locate the distance between intermediate portions 78 and 80 to ensure proper contact of opposing compression pads 34 with the container sides.

Figure 5:
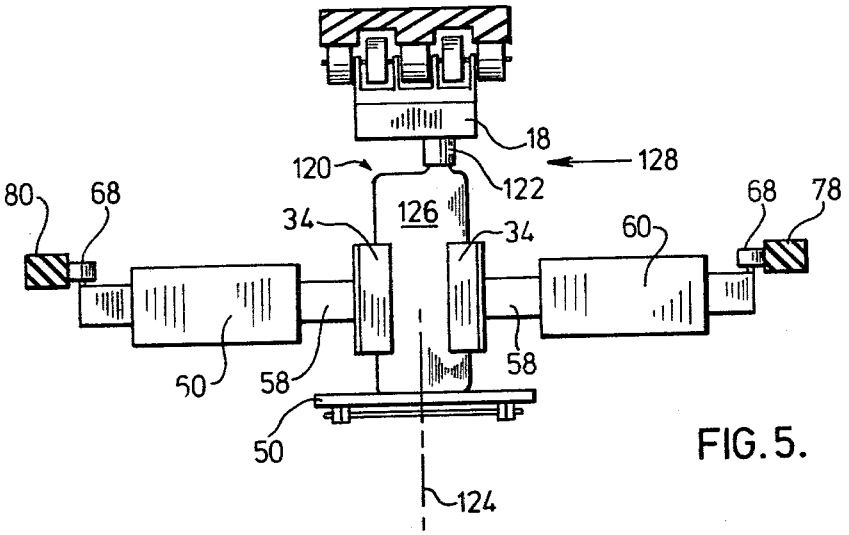
FIG. 5 is an end view illustrating the manner in which a bottle having an offset neck is shifted laterally on the conveyor.

This arrangement also provides for lateral shifting of containers 92 on the conveyor 50. In this particular labelling operation, lateral shifting of bottles on conveyor is desirable when the bottle neck and top are offset relative to the conveyor central axis during the application of labels to the container front and back portions. Turning to FIG. 5, the conveyor 50 has located on it a container 120 with a neck and top portion 122 offset relative to the centre line 124 of conveyor 50. The body portion 126 of the container is centrally aligned with the central axis of the conveyor for receipt of body labels. In most instances, the security seal applying device is aligned with the centre line of the conveyor because most bottles to be labelled are of symmetrical shape. The bottle 120 must be shifted, however, in the direction of arrow 128 to align the top portion 122 with applying device 36. In order to shift the bottle on the conveyor, the adjustment means 110 is used to shift the cam rails 70 and 72 in the direction of arrow 128 to the extent that, once the compression pads have equalized and are in the intermediate portions 78, 80 of the cam rails, the container top 122 is aligned with the central axis 124 of the conveyor 50.

Figure 6:
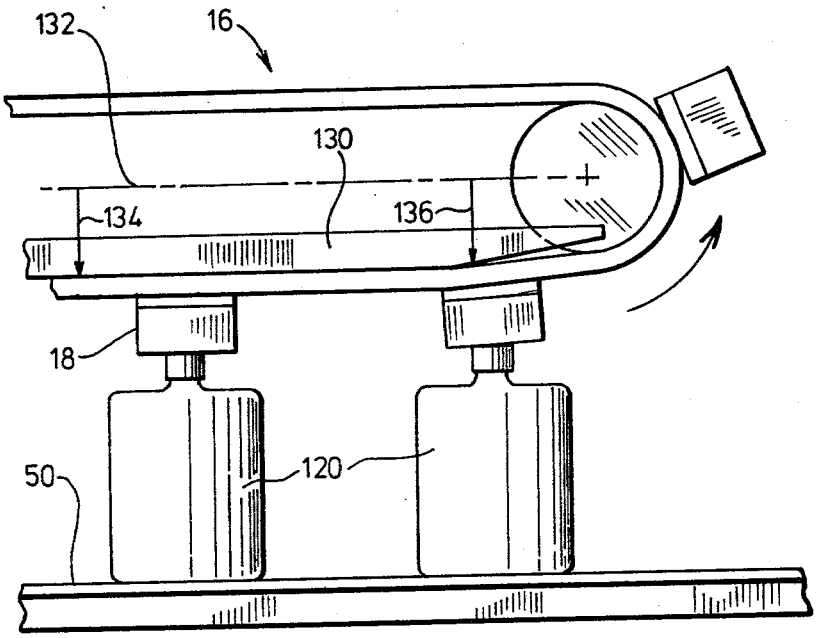
FIG. 6 is a detail of the bottle overhead engaging means at its downstream end.

To facilitate this shifting of the container 120, the overhead engagement means 16, the detail which is shown in FIG. 6, has a cam rail 130 which determines in a precise manner the distance between resilient pads 18 and conveyor 50. As mentioned, this distance determines the frictional force exerted on the containers to hold them in position. The cam 130 is thinner at its downstream end, so that dimension 134 is greater than dimension 136. This reduces the frictional force exerted on the bottle at the downstream end as it is sandwiched between block 18 and conveyor 50. The pressure on the bottle at the exit has to be, of course, sufficient to maintain the precise control on container position on the conveyor 50.

The offsetting forces exerted by the compression pads 34 are sufficient to overcome the frictional force exerted on the bottle by the overhead assembly as the bottle tops slide out from under resilient blocks 18 and are shifted the desired amount in the direction of arrow 128, as shown in FIG. 5. This arrangement avoids any scuffing of the blocks 18 or 34 as the bottle top disengages block 18, so that the precise location of the labels on the container sides is maintained without any label smudging, dislocation or tearing of the labels.

With some container configurations having a high degree of neck offset relative to the container body, the above arrangement is not always satisfactory for laterally shifting the bottles on the conveyor. However, the cam rails may have downstream of a first portion of the intermediate portions 78, 80, a parallel lateral offset in the cam rails. The first portion of the cam rails ensures that the opposing compression pads properly contact and sandwich the respective bottle. The lateral offset in the cam rails then serves via moving the compression pads to shift the bottle laterally of the conveyor the desired extent for accurate receipt on its top of a label strip. The positioning of the laterally offset portion in the cam rails is such that shifting of the bottle takes place after the overhead container engaging means has disengaged the respective container. A representative showing of this cam rail configuration is in FIG. 7. The cam rails 70 and 72 include parallel laterally offset portions 71 and 73. They have lead in portions 75 and 77 which ensure a smooth shifting of each bottle across conveyor 50. Portions 78 and 80 of the cam rails ensure that the opposing compression pads have firmly contacted the bottle before cam followers 68 move onto portions 75 and 77. The centre line 140 of the conveyor bisects the body portion of the container 142 for receipt of body labels. The particular shape for cam rails 70 and 72 cause a shifting of the container 142 so that its neck and top 144 is now aligned with the centre line 140 for receipt of the strip label.

Figure 7:
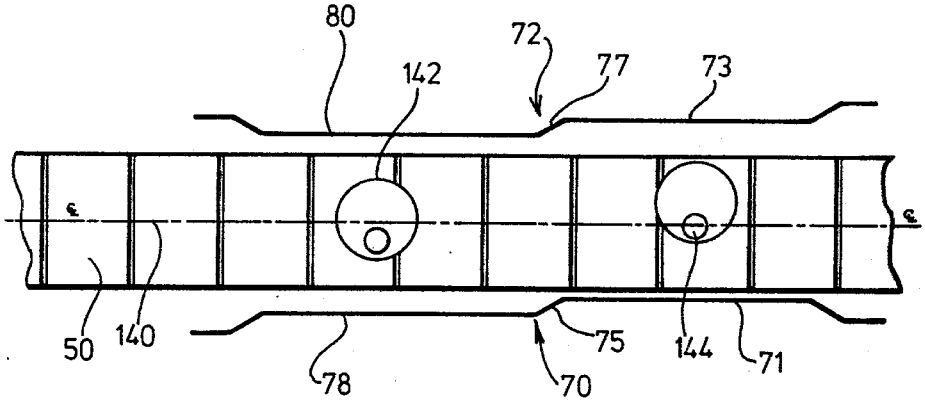
FIG. 7, which appears with FIG. 4, is a plan view of alternative cam rail configuration for the label compression station.
Figure 8:
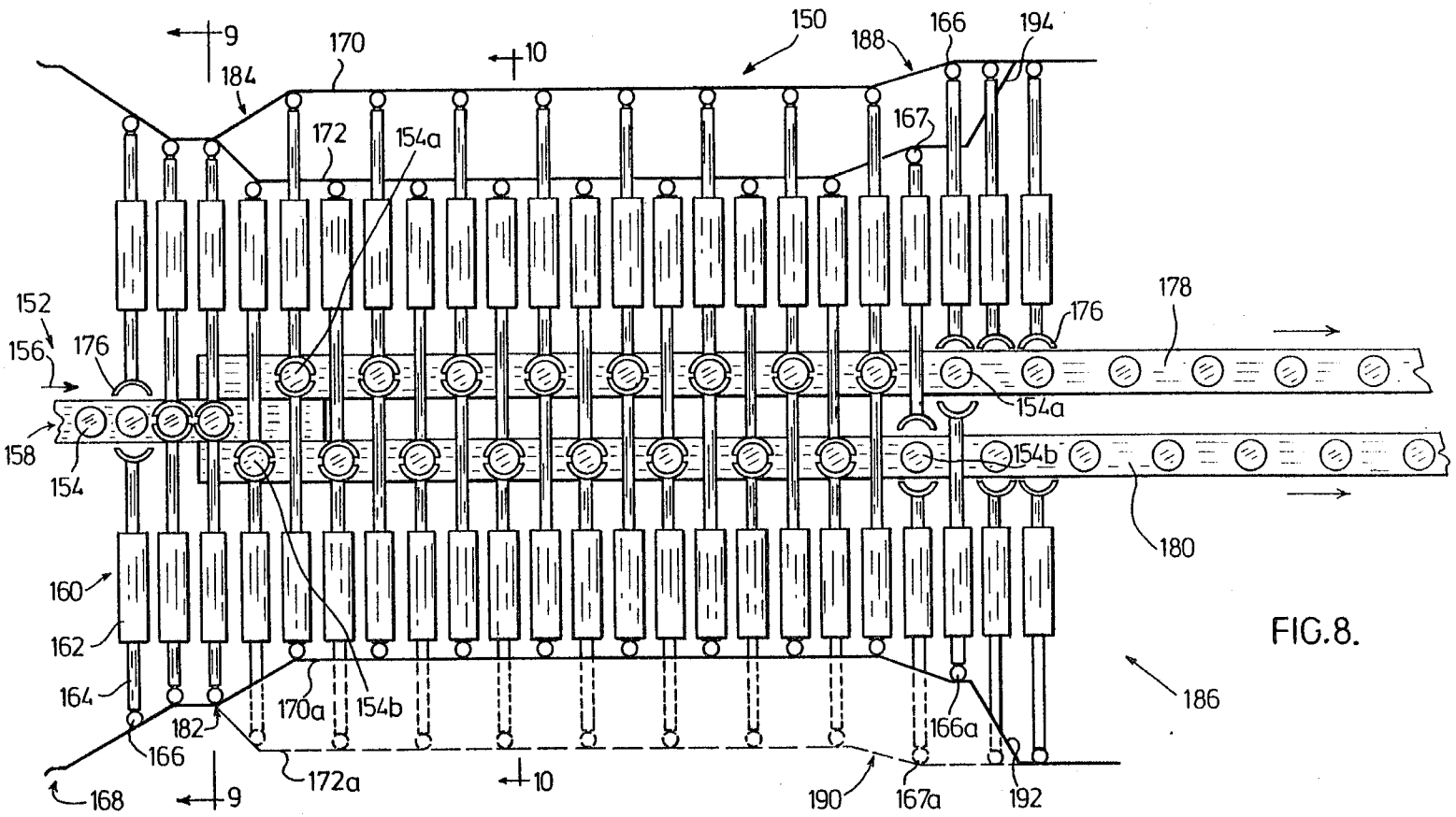
FIG. 8 is a top view of container conveying apparatus wherein means is provided for shifting a single row of conveyed containers to provide two parallel rows of containers.

It can, therefore, be appreciated that the shifting of containers on a conveyor, described with respect to FIGS. 5 and 7, may be useful for other types of container conveying apparatus. Referring to FIG. 8, another application of bottle lateral shift on the conveyor is shown. The apparatus for effecting bottle shift is generally designated 150. A single row 152 of containers 154, conveyed in the direction of arrow 156, are moving towards the container shifting apparatus 150. The single row of containers 152 is evenly spaced-apart on the single conveyor bed 158. This even spacing between containers may be accomplished by various registration means, such as that designated 14 in FIG. 2. In instances when it is desired to take this single row of conveyed containers and split or divide it into two parallel rows of spaced-apart containers, to accomplish a subsequent operation on the containers, the bottle shift mechanism 150 may be employed.

In this particular embodiment for the bottle shift mechanism, a plurality of opposing pairs of compression pad assemblies 160 are used. The body portions 162 of each compression pad assembly may be of the type shown in FIG. 3, where they are secured to chains which cause the compression pad assembly to move through a loop which is essentially in a vertical plane. The plunger or rod portion 164 of each compression pad assembly includes a cam follower 166 which engages lead in cam portions generally designated 168 for the bottle shift mechanism. The compression pad assemblies 160 may include tension springs to resiliently urge or bias the cam followers 166 against the cam rails.

In this particular instance, the bottles which are being shifted, may be of normal configuration, where the bottle tops are symmetrically aligned with the central axis of the bottle. The need for dividing the single row of containers into two rows is due to the spacing between the bottles in the single row being too narrow to permit the strip labeller to apply strips to the bottle tops.

Figure 9:
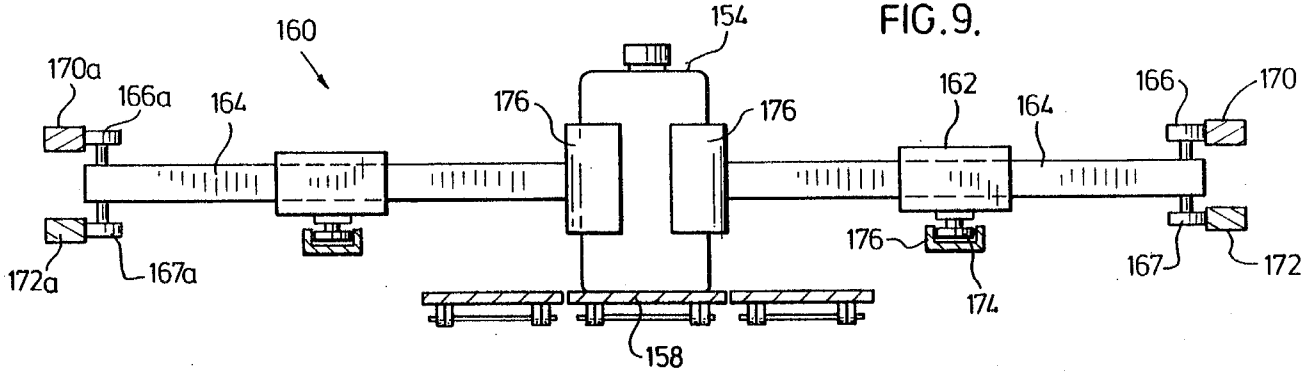
FIG. 9 is a section taken through lines 9—9 of FIG. 8.

To accomplish the division of the single row into two parallel rows, while maintaining container orientation, alternate pairs of compression pad assemblies have their positions controlled by a corresponding pair of cam rails. As shown in FIG. 9, the plunger portions 164 of each compression pad assembly overlaps where the distinct relationship of respective cam followers to upper and lower cam rails is shown. The cam rail assembly includes two pairs of opposing cam rails; namely, an upper pair of opposing cam rails 170 and **170*a* and a lower pair of opposing cam rails 172 and 172*a*. The compression pad assemblies 160 include cam followers 166 and 166*a* which contact the corresponding upper cam rails and other compression pad assemblies include cam followers 167 and 167*a* which contact the lower set of opposing cam rails. As shown in FIG. 9, the sleeves 162 include depending guide rollers 174 which travel along in channels 176 to assist guiding of the sleeves in the manner discussed with respect to FIG. 3**.

As the compression pad assemblies engage the individually conveyed bottles, the cam followers 166 and 167 bring the compression pads 176 into engagement with the containers as the cam followers move up the lead in portion 168 of upper and lower can rails 170 and 172. At this point, the containers are grasped by the compression pads 176 and their position held relative to the single conveyor 158.

The single conveyor 158 leads into parallel conveyors 178 and 180 where there is an overlap of the conveyors in the region of the end of conveyor 158 and the beginning of conveyors 178 and 180 to provide an area over which the bottles may be shifted laterally to provide the two rows.

At the juncture of the upper and lower cam rails generally designated 182, one set of compression pad assemblies are urged by cam rails **170–170*a* to move corresponding containers to the left of the single conveyor and the other set of compression pad assemblies are urged by cam rails 172–172*a* to move corresponding containers to the right of the single conveyor. The shifting of the bottle to the right or left is determined by portions generally designated 184 of the cam rails, so that container 154*a* is positioned on conveyor 178 and container 154*b* is positioned on conveyor 180. The compression pad assemblies have laterally shifted the containers while maintaining their original position relative to the length of the conveyor, so that the spacing between containers 154*a* is double the spacing between containers 154. The same applies with respect to the containers 154*b* on conveyor 180**.

Figure 10:
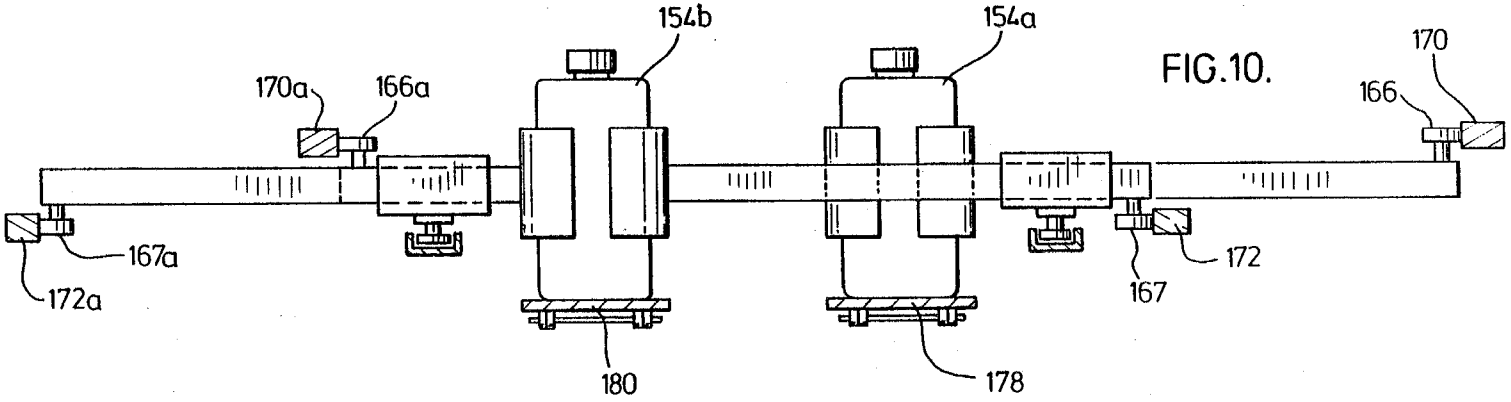
FIG. 10 is a section taken through lines 10—10 of FIG. 8.

The relationship of the compression pad assemblies with respect to the shifted containers is shown in FIG. 10. The cam followers, in contact with respective cam rails, determine the positions of corresponding compression pads, therefore, the two pairs of opposing cam rails accomplish the shifting of containers 154 in either direction to provide the desired two parallel rows of conveyed containers.

This increased spacing between containers, as mentioned, may be applicable in one particular instance to applying strip stamps to containers. The increased spacing between the containers **154*a* and 154*b* now allows strip stamper mechanisms to apply strip stamps to the tops of both rows of containers. The strip stamp labellers may be of the type shown in FIG. 1 and designated 38**.

The length of the bottle shift mechanism 150 may be significantly shorter than that shown; however, this embodiment is for use with bottles which have been freshly labelled on their sides with labels. The compression pad assembly picks up the labelled bottles and by sandwiching them ensures securement of labels to bottle.

After the strip stamps have been applied to the containers 154*a* and 154*b*, the compression pad assemblies 160 release their engagement with the containers in the manner shown in the area 186 of the assembly. The cam followers 166 move down the cam rail portion 188 and 166*a*, down cam rail portion 190 to release their engagement and similarly the cam followers 167 and 167*a* release engagement with the container 154*b*. To ensure that all compression pads 176 are clear of the dual conveyors 178 and 180, there is a further outward ramp portion 192 in upper cam rail 170*a* and ramp portion 194 in the lower cam rail 172. This retraction of the pads permits them to return around the endless loop to lead in portions 168 to re-engage containers in the single row.

Figure 11:
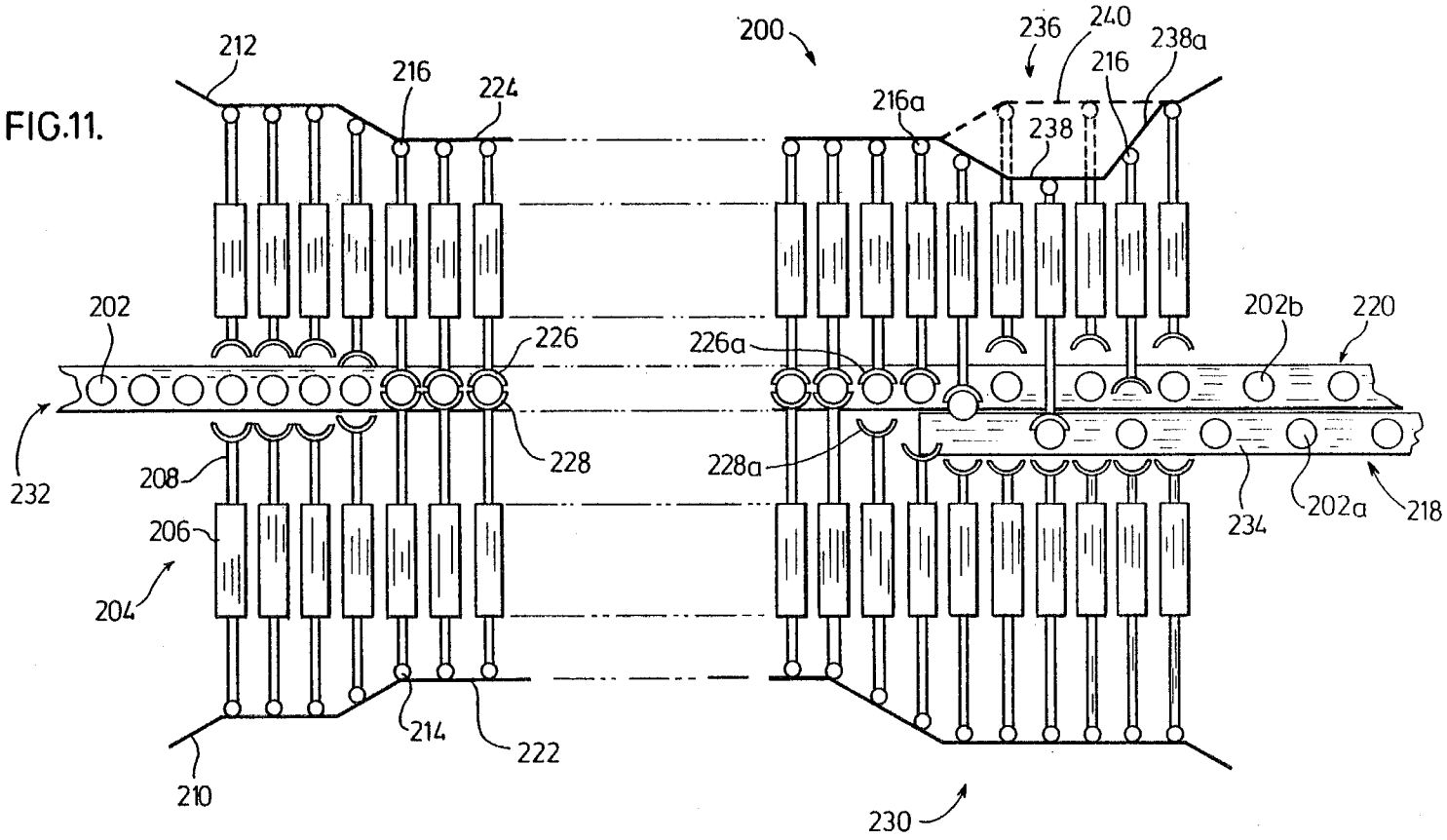
FIG. 11 is a top view of modified container conveying apparatus.

FIG. 11 shows a modification to the compression pad assembly area of FIG. 2. As mentioned, there are instances when it is desired to discharge two rows of containers from the labelling apparatus, such as when it is desired to inspect labelled containers at slower speeds or in instances when it is desired to provide multiple rows of containers for purposes of packaging. In these circumstances, the orientation and spacing of the containers is no longer critical, therefore, the compression pad assembly can be modified to achieve this desired shifting of containers to provide two or more rows. The container shifting device is generally designated 200 where a single row of conveyed containers 202 have been registered by way of a device, such as that shown in FIG. 2. The compression pad assembly 204 includes body portions 206 housing plunger portions 208, the lateral movement of which is controlled by opposing cam rails 210 and 212 as the respective cam followers 214 and 216 contact the rails. As in the compression pad assemblies of FIG. 3, springs may be employed to resiliently urge the followers against the cam rails. The compression pad assembly may be mounted in the manner similar to that of FIG. 3, where they travel on endless chains about a loop which is in the vertical plane. Located above the compression pad assembly area 204 may be strip stamper, or the like, for applying excise tax stamps to conveyed bottles.

At the downstream end of the conveying apparatus, the cam rails 210 and 212 may be modified to effect compression pad movement which yields the desired two parallel rows 218 and 220 of spaced-apart containers 202*a* and 202*b*. During the intermediate portions 222 and 224 of the cam rails, the compression pads 226 and 228 firmly engage the container. The cam rail 222 has been modified in area generally designated 230 to provide a fall off portion whereby the corresponding compression pads 228*a* are removed from the conveyed containers thereby leaving compression pads 226*a* in contact with the conveyed containers. In parallel with the single conveyor system 232 is a second conveyor 234 which overlaps conveyor 232 in the area which containers are to be shifted.

In this instance, it is desired to shift every other container to provide the two parallel rows. As a result, the cam 212 includes a modification in the area 236 to split the single cam into two cam segments—upper segment 238 and lower segment 240. The corresponding cam followers 216 engage the upper cam segment and cam followers 216*a* are positioned to engage the lower cam segment 240. The arrangement may be such as that shown in FIG. 9 with respect to the location of cam followers 166 and 167 as they engage the upper and lower cam rails. With this provision, every other compression pad assembly, as it contacts a respective container, is shifted laterally of the conveyor so as to position containers 202*a* on conveyor 234. Cam follower 216, on riding down slope 238*a* of its cam, is then retracted to the position of the other compression pad assemblies so that they may be returned on the endless chain system for engagement with new containers in the single row.

As a result, employing the principle of operation of container shift, as described with respect to FIG. 8, the compression assembly of FIG. 2 may be modified to provide an arrangement which accomplishes shifting of containers using only one side of the compression pad assembly. As mentioned, this arrangement is most desirable in instances where orientation and spacing of containers is not critical. The arrangement is also considerably less costly than known arrangements which are added on to existing container conveying apparatus to accomplish such shifting of containers. Also the arrangement permits shortening up or providing a shorter section on one side of the compression assembly than the other side, while still achieving container shift to provide additional room for other components in the conveyor apparatus and also cutting back on the cost with respect to one side of the compression pad assembly arrangement. Further, in using a compression pad which already contacts a conveyed container, when the other compression pad is removed, permits shifting of the container without causing impact between conveyed container and pad which shifts the container. This overcomes the undesirable aspects of known container shifting devices which rely on a pad or device moving towards the conveyor, impacting the container and shifting it laterally of the conveyor.

A container conveying apparatus is, therefore, provided which includes a device for individually engaging containers and shifting such conveyed, engaged containers laterally on the conveyor to provide a repositioning of containers. As explained, this shifting of containers is useful in many areas outside of the labelling art; however, it is particularly applicable where a bottle neck portion is offset relative to its centre line, or where the spacing between containers is so narrow that subsequent strip stamping application could not be achieved unless the bottle spacing is increased. As a result, the need for bottle re-registration and bottle orientation is eliminated.

This bottle shifting mechanism may also be useful in instances where the speed at which the subsequent operation in treating a container is slower than that which produces the single row of containers. In splitting up the row, the slower functions can now be accomplished in the split rows, which include lesser number of bottles per minute to be handled.

It can be appreciated from the description of the shift mechanism operation that the single row of containers may be split into more than two rows by way of proper arrangement for the compression pad assemblies and the provision of additional pairs of cam rails. For example, the single row may be split into three conveyed rows by the provision of yet another set of cam rails which would control the compression pad assemblies to shift every third bottle to a position which is different from the positions of the other two bottles. Further, it is understood that the mechanism of FIG. 8 may be adapted to shift only every other bottle where the remaining bottles travel along the same path as the original single row. In instances where it is desired to maintain container orientation, the complete set of compression pad assemblies may be provided to engage and hold the containers which continue travel along the same path. That arrangement would, therefore, require that conveyor 158 continue alongside either conveyor 178 or 180, depending upon which way every other bottle is to be shifted.

It is also understood that the bottle shifting mechanism of FIG. 11 may be modified to shift bottles from a single row in a manner to provide triple row discharge for purposes of subsequent container handling. This flexibility in container shift is provided by the arrangement of cam rails controlling movement of the compression pads where multiple level of cam rails may be used to shift corresponding compression pads any desired extent to establish one or more new rows of conveyed containers.

It is also apparent that the labelling apparatus, according to this invention, includes a combination of elements which provide for a great degree of flexibility in labelling at high speeds bottles or containers of all shapes and sizes while maintaining precise control on the container position throughout the label application stages to ensure consistent accurate label application. The arrangement also provides for substantial reduction in shutdown time in adapting the apparatus to new container configurations where it is understood that adjustments for the height of the bottle is provided by the cranks 30 and 46, for the width of the bottle by adjustment means 110 and for change in bottle configurations by interchanging pad portions 34 of the compression station.

It is apparent from FIG. 1 that the timing of the strip label compression station 38 is such that the compression members 40 are aligned with the compression pads 34 so as to properly receive a bottle. Phase variators may be provided in the system, however, to accommodate bottle necks which, although they are aligned with the central axis of the conveyor, they are offset relative to the centre line of the container. As a result, the strip compression pad assembly 40 can be adjusted to be out of phase with the corresponding compression pads 34 to properly receive the bottle top and neck.

At the label applying station 24, only portions of the label contact the bottle and compression pads 34 complete the location of the label on the container. With this arrangement the compression pads pick up the bottle directly from the overhead station, where label portions not yet contacting the bottle are gradually moved onto the bottle face by the compression pads without tearing of the label or disruption of the label configuration. This constant contact on the container body labels is maintained until the strip label is at least on the container. There is no transfer of the bottle from the label compression station 34 to another system before the strip label is applied. There is sufficient time for the glue to set on the bottle, so that as the bottle exits from the assembly, all labels are in position and remain in position. Therefore, with this apparatus, there is very little chance of label smudging and the like and at the same time, there is an efficient effective control on the bottle positioning throughout the labelling process.

Although various embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. In container conveying apparatus, means for conveying containers, container registration means for evenly spacing such containers on said means for conveying, and means which travels with said means for conveying for individually engaging such containers to maintain container even spacing and shifting such conveyed engaged containers laterally a predetermined extent on said means for conveying.

2. In container conveying apparatus of claim 1, said means for engaging such containers comprising a plurality of opposing compression pads which travel alongside and with said means for conveying and which are adapted to receive and to sandwich individual containers therebetween, each pair of opposing compression pads with container therebetween being shifted laterally in unison the predetermined extent and releasing such shifted conveyed container.

3. In container conveying apparatus of claim 2, said compression pads are laterally movable relative to the length of said conveyor means, at least a pair of opposing cam rails are mounted on each side of said conveyor, each said compression pad having a cam follower and means for resiliently urging said cam follower against its corresponding cam rail, each cam rail being so configured to move the respective compression pad inwardly to contact the respective container side to thereby sandwich such container between opposing compression pads, said at least one pair of opposing cam rails being adapted to cause each pair of opposing compression pads to shift laterally in unison thereby shifting such engaged container laterally of said conveyor means to the predetermined extent.

4. In container conveying apparatus of claim 3, said at least one pair of cam rails being adjustable laterally of the conveyor to positions which cause said compression pads, upon contacting such containers, to shift the containers laterally.

5. In container conveying apparatus of claim 3, said at least one pair of cam rails having a parallel lateral offset portion which is adapted to move opposing compression pads laterally of the conveyor to achieve the desired container shift.

6. In container conveying apparatus of claim 1, said means for individually engaging such containers being adapted to shift such containers in opposite directions to provide two rows of conveyed containers having double the spacing between containers as registered.

7. In container conveying apparatus of claim 6, said means for individually engaging such containers comprising a plurality of opposing compression pads which travel alongside and with said means for conveying and which are adapted to receive and to sandwich individual containers therebetween, each pair of opposing compression pads with container therebetween being shifted laterally in unison the predetermined extent and releasing such shifted conveyed container.

8. In container conveying apparatus of claim 7, said compression pads are laterally movable relative to the length of said conveyor means, two cam rails being mounted on each side of said conveyor to provide two pair of opposing cam rails, each pair of opposing cam rails determining the direction in which a sandwiched container is shifted by said compression pads, each pair of cam rails being so configured to move the respective opposing compression pads inwardly to contact and sandwich a respective container prior to shifting such container in a desired direction.

9. In container conveying apparatus of claim 8, said two pairs of opposing cam rails being laterally offset relative to each other, a distance which provides the desired spacing between the provided parallel rows of evenly spaced-apart containers.

10. Labelling apparatus for applying a label strip to container tops, said apparatus comprising conveyor means for conveying evenly spaced-apart containers along said apparatus and means which travels with said conveyor means for individually engaging containers and shifting such engaged conveyed container laterally of the conveyor means to align such container top with label strip applying means which applies an individual label strip to each container top.

11. Labelling apparatus of claim 10, wherein at least every other container of a single row of evenly spaced-apart containers is shifted by said means for engaging such containers to provide two rows of conveyed containers having double the spacing between containers of such single row, a label strip applying means located over each of the parallel rows of conveyed containers to apply label strips to container tops of each row.

12. Labelling apparatus of claim 11, wherein two cam rails are mounted on each side of said conveyor to provide two pairs of opposing cam rails, each pair of opposing cam rails determining the movement of a respective pair of opposing compression pads in shifting containers laterally of said conveyor, each compression pad has a cam follower and means for biasing said cam follower against the corresponding cam rail, a first pair of cam rails causing said opposing compression pads with a container sandwiched therebetween to shift such container laterally in a first direction and the other pair of opposing cam rails causing its corresponding pair of opposing compression pads to shift a sandwiched container in an opposite direction to provide two parallel conveyed rows of spaced-apart containers having a spacing double that prior to lateral offset.

13. Labelling apparatus of claim 10, wherein said means for engaging such containers comprises a plurality of opposing compression pads which travel alongside and with said conveyor and which are adapted to receive and sandwich individual containers therebetween, each pair of opposing compression pads with container therebetween being shifted laterally in unison a predetermined extent and releasing such shifted conveyed container subsequent to application of a label strip to a container top.

14. Labelling apparatus of claim 13 for applying label strips to containers whose tops are offset relative to the centre line of said conveyor, said compression pads shifting each sandwiched container laterally on said conveyor to align such container tops for accurate receipt of label strips from label strip applying means.

15. Labelling apparatus of claim 14, wherein two cam rails are mounted on each side of said conveyor to provide two pairs of opposing cam rails, each compression pad having cam follower and means for biasing said cam follower against its corresponding cam rail, the pair of cam rails being so configured to move the opposing compression pads inwardly to contact and sandwich therebetween the container, said cam rails being adjustable to positions which cause said compression pads, upon sandwiching a container, to move in unison in shifting such container laterally on said conveyor to align a said container top with means for applying the label strip.

16. Labelling apparatus of claim 15, wherein said pair of cam rails each have a parallel lateral offset portion which is adapted to move said compression pads in unison laterally of said conveyor to shift a sandwiched container laterally on said conveyor.

17. Labelling apparatus for applying labels to container sides and applying a label strip to such container tops, said apparatus comprising a conveyor for conveying containers along said apparatus, container registration means for evenly spacing such containers on said conveyor, overhead container engaging means which contacts container tops and travels with them to hold them in their registered position on said conveyor, a label applying station for applying labels to such container sides as they are conveyed past said label applying station and held in position by said overhead container engaging means, a label compression station which begins compressing such labels against such container sides prior to said overhead engaging means disengaging such containers, said label compression station comprising a plurality of opposing compression pads moving with said conveyor and which are laterally movable relative to the conveyor's length, at least one cam rail mounted on each side of said conveyor to provide at least one pair of opposing cam rails, each opposing pair of compression pads having cam followers and means for biasing said cam followers against their respective cam rails, each pair of opposing cam rails being so configured to move their respective pair of compression pads inwardly to contact respective container sides and press such labels against such container, said cam rails being adjustable to positions which cause said compression pads, upon contacting such containers, to shift such containers laterally on said conveyor to align such container tops for accurate receipt of label strips from label strip applying means.

18. Labelling apparatus of claim 17, wherein a pair of opposing cam rails has parallel lateral offset portions which are adapted to move a pair of compression pads laterally of said conveyor to shift each container laterally to a predetermined extent.

19. Labelling apparatus of claim 17, wherein a row of labelled container sides is divided into two parallel rows of spacing double that of the single row, said label compression station comprising two pairs of opposing cam rails where each pair of cam rails in combination with corresponding opposing compression pads shifts every other container in a direction opposite to that of the other containers to provide such parallel rows, a pair of label strip applying means for applying label strips to each container top in each row.

20. Labelling apparatus of claim 19, wherein each pair of cam rails has parallel, lateral offset portions which are adapted to move a corresponding pair of compression pads laterally of said conveyor to shift a corresponding container laterally of the conveyor to form one of the rows of containers.

21. Labelling apparatus of claim 19, wherein said two pairs of opposing cam rails are positioned such that there is an upper pair of cam rails and a lower pair of opposing cam rails, the pairs of opposing compression pads being adapted to engage either set of opposing cam rails to determine the direction of shift for a particular engaged container.

22. Labelling apparatus of claim 17, wherein said label strip applying means has a label strip compression means for pressing such label strips against such container tops prior to said compression pads withdrawing from such container sides.

23. Labelling apparatus of claim 17, including a container orientation means for orienting all such containers in the same direction on said conveyor prior to label application, said overhead container engaging means and said label compression station maintaining proper registration and orientation of such containers on said conveyor.

24. Labelling apparatus of claim 17, wherein said means for biasing said cam followers against said cam rails comprises a tension spring.

25. Labelling apparatus of claim 17, wherein said compression pads are mounted on two endless chain systems, each located on a side of said conveyor, said compression pads being located on said endless chain systems so that compression pads oppose one another and compress a container therebetween as such container is conveyed past said label compression station.

26. Labelling apparatus of claim 25, wherein said compression pad has a rod portion which is mounted in a sleeve, said sleeve being connected to said endless chain system, the end of said rod portion remote from said pad having said cam follower mounted thereon, said rod being spring loaded in a manner to bias said follower against said cam rail.

27. Labelling apparatus of claim 17, wherein each said cam rail is mounted on a support means positioned on each side of said conveyor, means for adjusting said cam rails including a screw shaft for engaging each support means so that rotation of said shaft laterally shifts the respective cam rail towards or away from said conveyor.

28. Labelling apparatus of claim 17, wherein said overhead container engagement means comprises a plurality of evenly spaced-apart resilient blocks mounted on an endless chain travelling along and above said conveyor, the spacing between such blocks and the speed at which said endless chain travels being such that each container top is contacted by a block and is sandwiched between such block and said conveyor for purposes of holding such container for application of labels to its sides, the distance between each block is its bottle contacting position and said conveyor determining the frictional force with which said container is held, said distance being increased slightly at the downstream end of said endless chain in the area where said opposing compressible pads first contact a container to decrease sufficiently the frictional force holding such container and allow the force exerted by said compressible pads in laterally shifting said container on said conveyor to overcome said friction force without causing tilting movement of said container between said compressible pads.

29. In a container conveying apparatus, means for conveying a row of containers, container registration means for evenly spacing such containers on said means for conveying, a plurality of opposing compression pads moving with said conveyor means, said compression pads being laterally movable relative to the length of said conveyor means, a pair of opposing cam rails, each mounted to a side of said conveyor means, each said compression pad having a cam follower and means for resiliently urging said cam follower against its corresponding cam rail, each cam rail being so configured to move the respective compression pad inwardly to contact the respective container side to thereby sandwich such container between opposing compression pads, one of said cam rails having at its downstream end at least two vertically spaced-apart cam segments, at least one of said cam segments causing a compression pad with corresponding cam follower to move laterally of said conveyor means and thereby shift laterally to a predetermined extent a corresponding contacted container to provide at least two rows of conveyed containers, the other cam rail being so configured to retract an opposing compression pad from an engaged container prior to lateral shift of a container.

30. In container conveying apparatus of claim 29, the extent of said cam rail opposite said cam rail having said cam segments being shorter than said cam rail having said cam segments.

31. In container conveying apparatus of claim 29 one said cam segment being disposed inwardly of the other to cwause compression pads having cam followers which engage such inward disposed cam segment to shift such contacted containers to provide two rows of containers.

32. In container conveying apparatus of claim 31, said conveyor means comprising a pair of conveyors, one of said conveyors extending the length of said apparatus, the other conveyor beginning in the area of container shift to convey a newly established moving row of containers.

33. In container conveying apparatus, means for conveying containers, container registration means for evenly spacing such containers on said means for conveying, and means for individually engaging containers in a single row of conveyed containers and travelling with said means for conveying in maintaining container even spacing, said means for engaging containers shifting predetermined containers of the conveyed row a predetermined extent on said means for conveying to provide two rows of conveyed containers.

34. In container conveying apparatus of claim 35, said means for engaging such containers comprising a plurality of opposing compression pads which travel alongside and with said means for conveying and which are adapted to receive and to sandwich individual containers therebetween, each pair of opposing compression pads with a predetermined container therebetween being shifted laterally in unison the predetermined extent and releasing such shifted predetermined conveyed container to provide said two rows of conveyed containers.

35. In container conveying apparatus of claim 33, said means for individually engaging such containers being adapted to shift every other conveyed container to provide two rows of conveyed containers having double the spacing between containers as registered.

36. In container conveying apparatus of claim 35, said compression pads are laterally movable relative to the length of said conveyor means, two pair of opposing cam rails are mounted on each side of said conveyor, each said compression pad having a cam follower and means for resiliently urging said cam follower against its corresponding cam rail, each cam rail being so configured to move the respective compression pad inwardly to contact the respective container side to thereby sandwich such container between opposing compression pads, one pair of said opposing cam rails being adapted to cause every other pair of opposing compression pads to shift laterally in unison thereby shifting such engaged predetermined container laterally of said conveyor means to the predetermined extent.

37. In container conveying apparatus of claim 36, said one pair of cam rails having parallel lateral offset portions which are adapted to move every other pair of opposing compression pads laterally of the conveyor to achieve the desired shift of every other conveyed containers.

38. In container conveying apparatus of claim 37, said two pairs of opposing cam rails are positioned such that there is an upper pair of cam rails and a lower pair of opposing cam rails, the pairs of opposing compression pads being adapted to engage either set of opposing cam rails to determine the shifting of every other conveyed container.

39. In container conveying apparatus of claim 38, compression pads are mounted on two endless chain systems, each located on a side of said conveyor, said compression pads being located on said endless chain systems so that compression pads oppose one another and compress a container therebetween as such container is conveyed.

40. In container conveying apparatus of claim 39, said compression pad has a rod portion which is mounted in a sleeve, said sleeve being connected to said endless chain system, the end of said rod portion remote from said pad having said cam follower mounted thereon, said rod being spring loaded in a manner to bias said follower against the respective cam rail.

41. In container conveying apparatus of claim 40, each said cam rail is mounted on a support means positioned on each side of said conveyor, an adjustment means including a screw shaft for engaging each support means so that rotation of said shaft laterally shifts the respective cam rail towards or away from said conveyor.

* * * * *